US009987723B2

(12) United States Patent
Chuang

(10) Patent No.: US 9,987,723 B2
(45) Date of Patent: Jun. 5, 2018

(54) GRINDING MACHINE WITH ADJUSTABLE WORK BENCH

(71) Applicant: Po Chang Chuang, Taichung (TW)

(72) Inventor: Po Chang Chuang, Taichung (TW)

( * ) Notice: Subject to any disclaimer, the term of this patent is extended or adjusted under 35 U.S.C. 154(b) by 90 days.

(21) Appl. No.: 15/344,573

(22) Filed: Nov. 6, 2016

(65) Prior Publication Data

US 2018/0043502 A1 Feb. 15, 2018

(30) Foreign Application Priority Data

Aug. 12, 2016 (TW) ..... 105212260 U

(51) Int. Cl.
*B23B 41/00* (2006.01)
*B24B 41/00* (2006.01)
*B24B 41/06* (2012.01)

(52) U.S. Cl.
CPC ..... *B24B 41/005* (2013.01); *B24B 41/068* (2013.01)

(58) Field of Classification Search
CPC ..... B24B 41/005; B24B 41/068; B27C 5/02
USPC ..... 451/336
See application file for complete search history.

(56) References Cited

U.S. PATENT DOCUMENTS 3,132,451 A * 5/1964 Kile ..... B27C 1/02 144/129
3,208,187 A * 9/1965 Ernst ..... B24B 21/18 451/300
3,394,501 A * 7/1968 Carlson ..... B24B 7/12 144/128
3,952,459 A * 4/1976 Negley ..... B24B 21/00 451/300
4,067,370 A * 1/1978 Chang ..... B24B 3/247 451/375
4,258,506 A * 3/1981 Robinson ..... B27C 1/12 144/117.1
4,399,637 A * 8/1983 Steinback ..... B24B 41/005 451/300
4,450,653 A * 5/1984 Fletcher ..... B24B 21/12 451/184
5,722,472 A * 3/1998 Wang ..... B23Q 37/002 144/1.1
5,882,157 A * 3/1999 Buysman ..... B24D 15/08 248/171
5,979,520 A * 11/1999 Behrendt ..... B29C 73/26 144/117.1
6,427,735 B1 * 8/2002 Brazell ..... B28B 11/0809 144/114.1
6,863,601 B1 * 3/2005 Wang ..... B27C 1/04 144/114.1
7,252,124 B1 * 8/2007 Chuang ..... B27C 1/04 144/117.1

(Continued)

*Primary Examiner* — George Nguyen
(74) *Attorney, Agent, or Firm* — Rosenberg, Klein & Lee

(57) ABSTRACT

A grinding machine includes a support and a board which is connected to the connection portion of the support. The board has a first opening and a second opening. A transportation device is connected across over the first and second openings. A grinding device has a driving portion and a grinding portion which is connected to the driving portion. The driving portion is connected to the support so that the grinding portion is located above the transportation device. An angle adjustment device is connected between the board and the transportation device so as to adjust inclination of the transportation device so as to grind a larger area of an object.

7 Claims, 9 Drawing Sheets

(56) References Cited

U.S. PATENT DOCUMENTS

| | | | | |
|---|---|---|---|---|
| 2008/0230149 | A1* | 9/2008 | Chuang | B27C 1/04 144/128 |
| 2010/0184356 | A1* | 7/2010 | Haddadi | B24B 9/148 451/5 |
| 2012/0175019 | A1* | 7/2012 | Chuang | B27C 1/04 144/130 |
| 2016/0121459 | A1* | 5/2016 | Mizuura | B24D 5/00 451/194 |

* cited by examiner

GRINDING MACHINE WITH ADJUSTABLE WORK BENCH

BACKGROUND OF THE INVENTION

1. Fields of the Invention

The present invention relates to a grinding machine for polishing or grinding objects, and more particularly, to an adjustable work bench of a grinding machine.

2. Descriptions of Related Art

The conventional grinding machine is widely used for surface treatment to wood objects or metal objects to remove surplus and obtain a smooth surface. A conventional grinding machine known to applicant includes two rollers with a rubber belt going about the two rollers so as to transport objects to be ground or polished. However, the conventional grinding machine cannot adjust the tightness and the angle of the rubber belt or the sand belt so that it is difficult to ground the surface of a larger object.

The present invention intends to provide an adjustable work bench of a grinding machine so as to adjust the tightness and the angle of the rubber belt such that the shortcomings mentioned above are eliminated.

SUMMARY OF THE INVENTION

The present invention relates to a grinding machine and comprises a support and a board which is connected to the connection portion of the support. The board has a first opening and a second opening. A transportation device is connected across over the first and second openings. A grinding device has a driving portion and a grinding portion which is connected to the driving portion. The driving portion is connected to the support so that the grinding portion is located above the transportation device. An angle adjustment device is connected between the board and the transportation device so as to adjust inclination of the transportation device so as to grind a larger area of an object.

Preferably, the transportation device has the first side thereof connected to the board, and the second side of the transportation device is connected to the angle adjustment device.

Preferably, the angle adjustment device has a top plate, a bottom plate and a knob, wherein the top plate is connected to the second side of the transportation device, and the bottom plate is connected to one side of the board. The top plate is located corresponding to the bottom plate. The knob extends through the top plate and is connected to the bottom plate.

Preferably, a fastening device is connected between the board and the second side of the transportation device.

Preferably, the transportation device includes a frame, a rubber belt, a first roller, a second roller and a motor. The first and second rollers are connected to two sides of the frame so as to stretch the rubber belt. The motor is connected to the first roller.

Preferably, the transportation device has a tightness adjustment device which is connected to the transportation device and the second roller.

Preferably, the grinding device has a height adjustment device which adjusts the height of the driving portion relative to the transportation device.

The advantages of the present invention are that the angle adjustment device on one side of the transportation device to micro-adjust the inclination of the transportation device so as to treat a larger area of an object.

The tightness of the rubber belt of the transportation device can be adjusted so that the object can be precisely ground, and the rubber belt is easily to be replaced.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
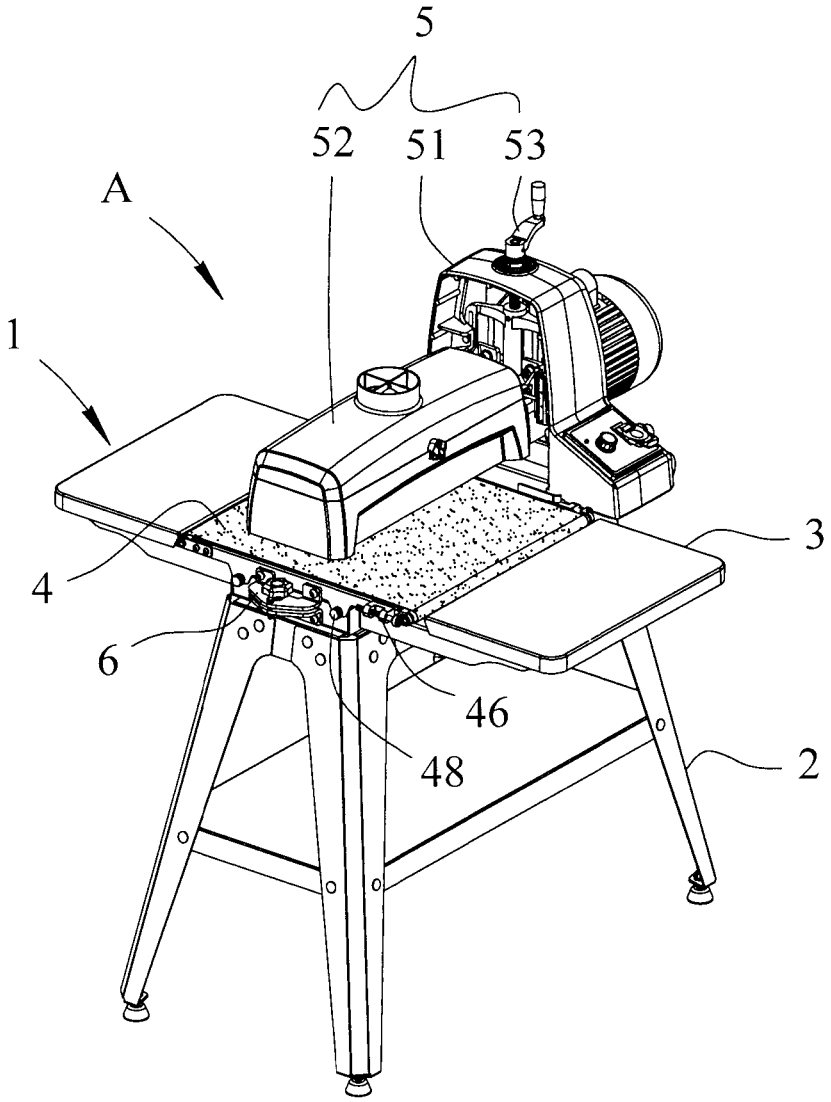
FIG. 1 shows the grinding machine of the present invention.
Figure 2:
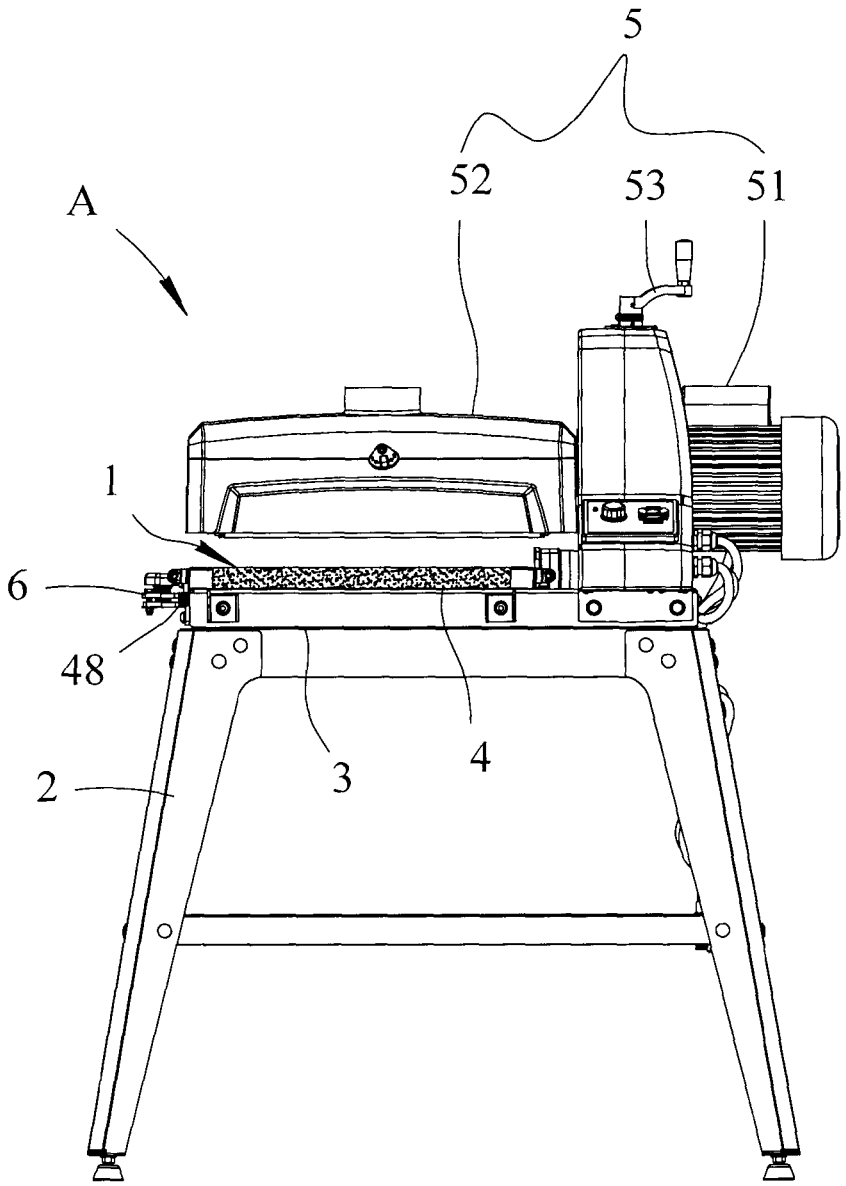
FIG. 2 is a side view to show the grinding machine of the present invention.
Figure 3:
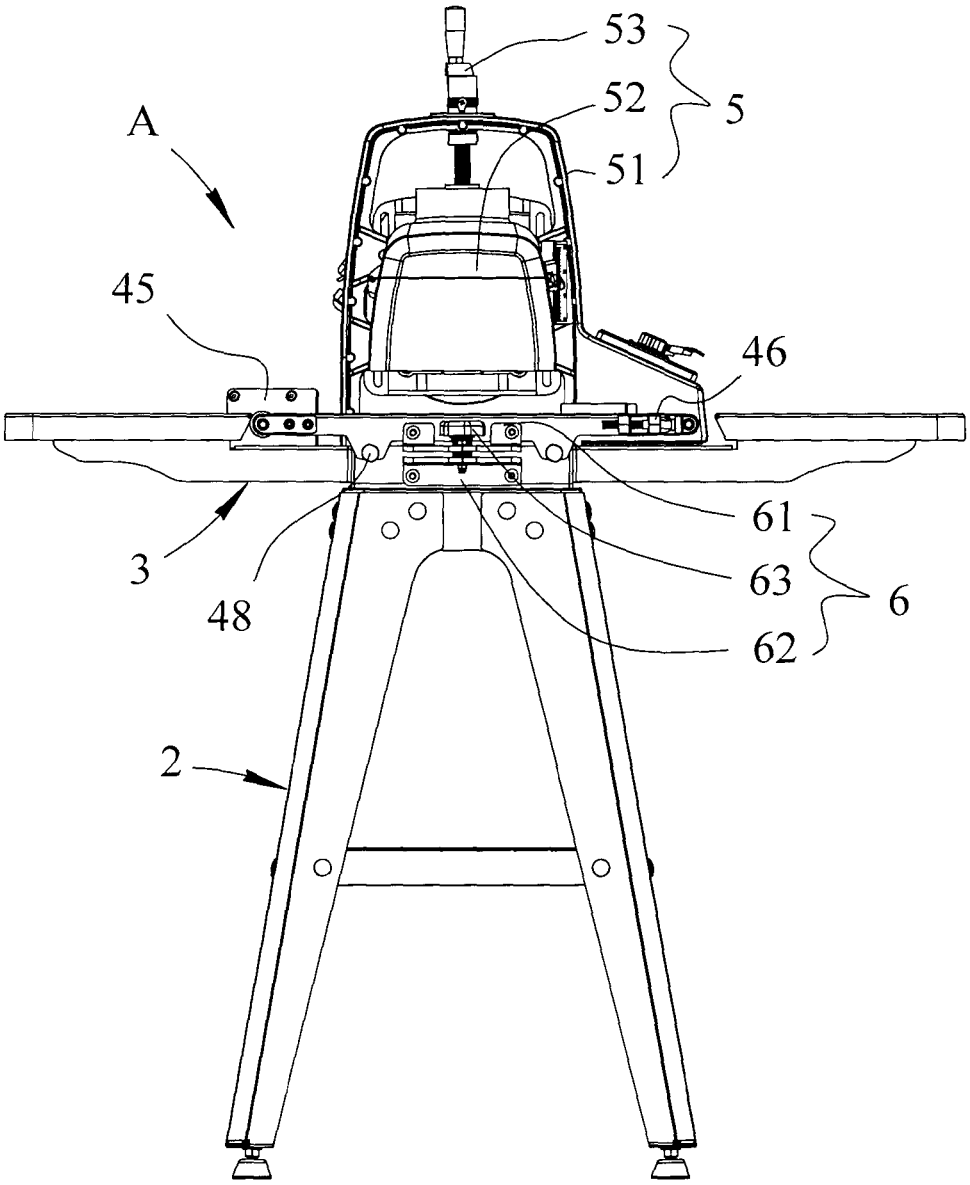
FIG. 3 is a front view to show the grinding machine of the present invention.

Referring to FIGS. 1 to 4, the grinding machine "A" of the present invention comprises an adjustable work bench 1 which has a support 2, a board 3, a transportation device 4, a grinding device 5 and an angle adjustment device 6.

The support 2 has a connection portion 21 which includes multiple holes and screws. The board 3 is connected to the connection portion 21 and has a first opening 31 and a second opening 32.

Figure 4:
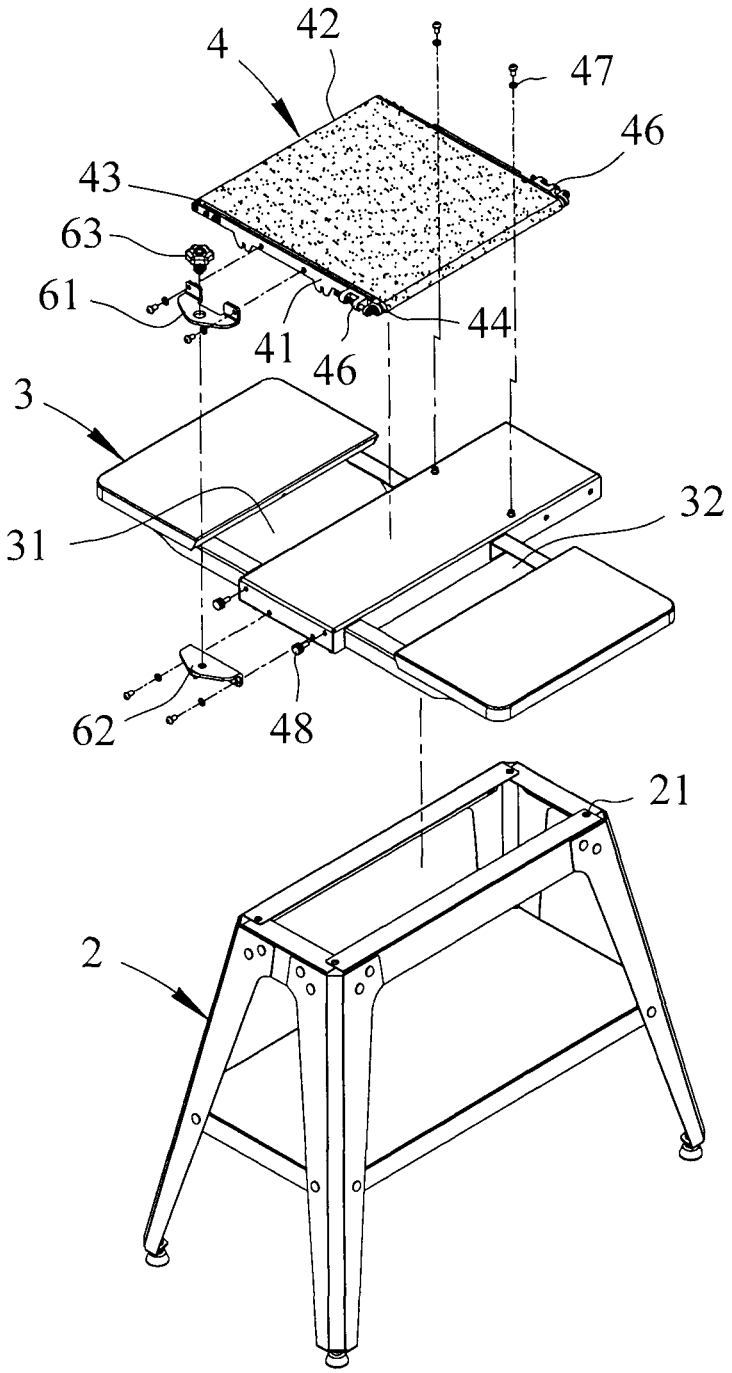
FIG. 4 is an exploded view to show the adjustable work bench of the grinding machine of the present invention.
Figure 5:
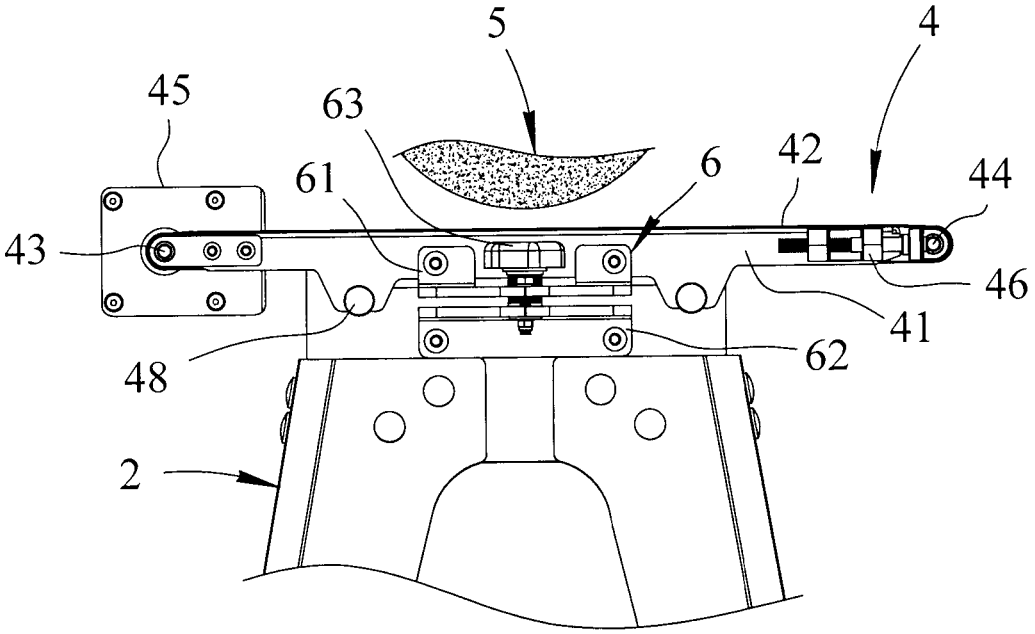
FIG. 5 is an enlarged front view of the adjustable work bench of the grinding machine of the present invention.

As shown in FIGS. 4 and 5, the transportation device 4 is connected across over the first and second openings 31, 32 to as to feed the object to be ground toward the grinding device 5. The transportation device 4 has the first side thereof connected to the board 3, and the second side of the transportation device 4 is connected to the angle adjustment device 6 by multiple screws 47.

The transportation device 4 includes a frame 41, a rubber belt 42, a first roller 43, a second roller 44 and a motor 45. The first and second rollers 43, 44 are connected to two sides of the frame 41 so as to stretch the rubber belt 42. The motor 45 is connected to the first roller 43. Besides, the transportation device 4 has a tightness adjustment device 46 which is connected to the transportation device 4 and the second roller 44. A fastening device 48 is connected between the board 3 and the second side of the transportation device 4.

The grinding device 5 has a driving portion 51 and a grinding portion 52 which is connected to the driving portion 51. The driving portion 51 is connected to the support 2 so that the grinding portion 52 is located above the transportation device 4. The grinding device 5 has a height adjustment device 53 which adjusts the height of the driving portion 51 relative to the transportation device 4.

Figure 6:
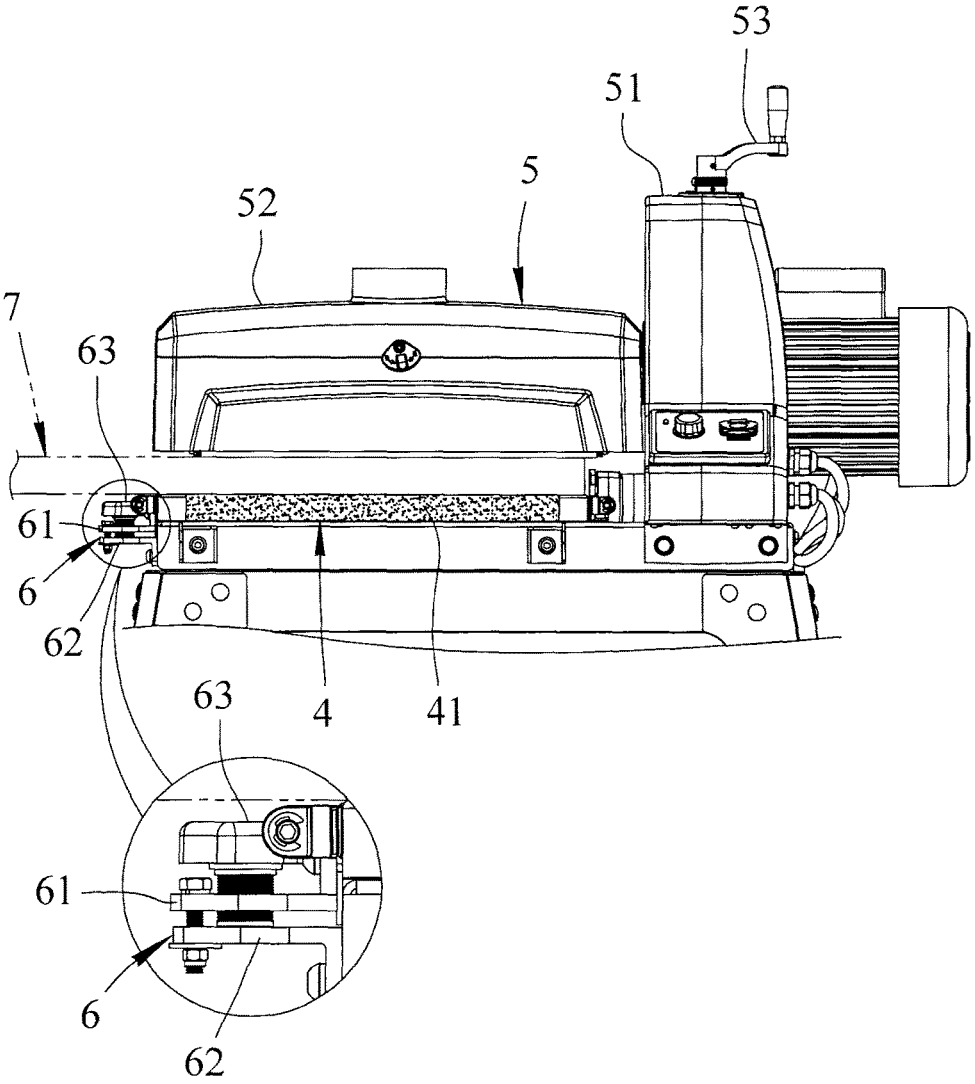
FIG. 6 is an enlarged side view of the adjustable work bench of the grinding machine of the present invention.

The angle adjustment device 6, as shown in FIGS. 5 and 6, is connected between the board 3 and the transportation device 4 so as to adjust inclination of the transportation device 4. The angle adjustment device 6 has a top plate 61, a bottom plate 62 and a knob 63. The top plate 61 is connected to the second side of the transportation device 4, and the bottom plate 62 is connected to one side of the board 3. The top plate 61 is located corresponding to the bottom plate 62. The knob 63 extends through the top plate 61 and is connected to the bottom plate 62.

As shown in FIG. 6, the users use the knob 63 of the angle adjustment device 6 on the side of the transportation device 4 to adjust the inclination of the transportation device 4, and then secure the transportation device 4*b* fastening device 48 so as to grind the surface of an larger object 7.

Figure 7:
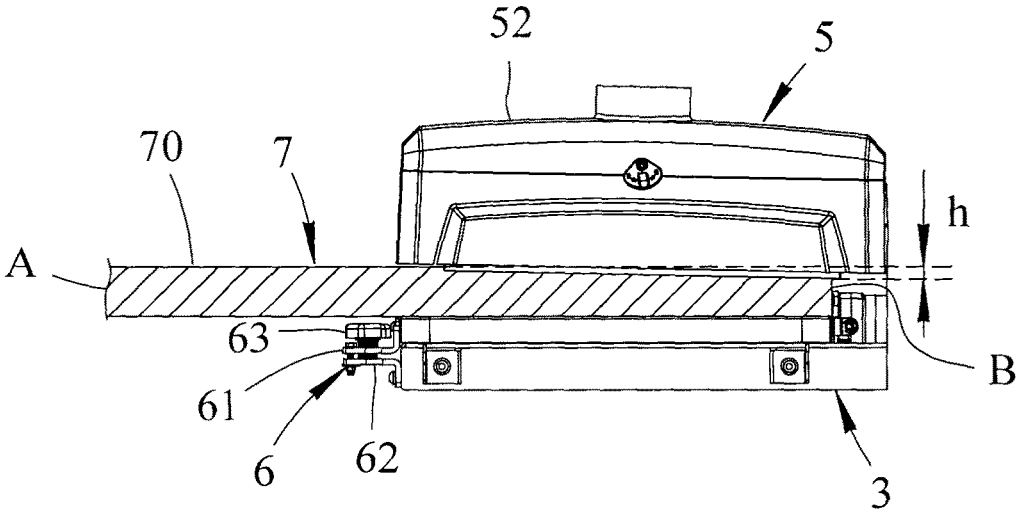
FIGS. 7-9 shows the consecutive operational statuses of the adjustable work bench of the grinding machine of the present invention.
Figure 8:
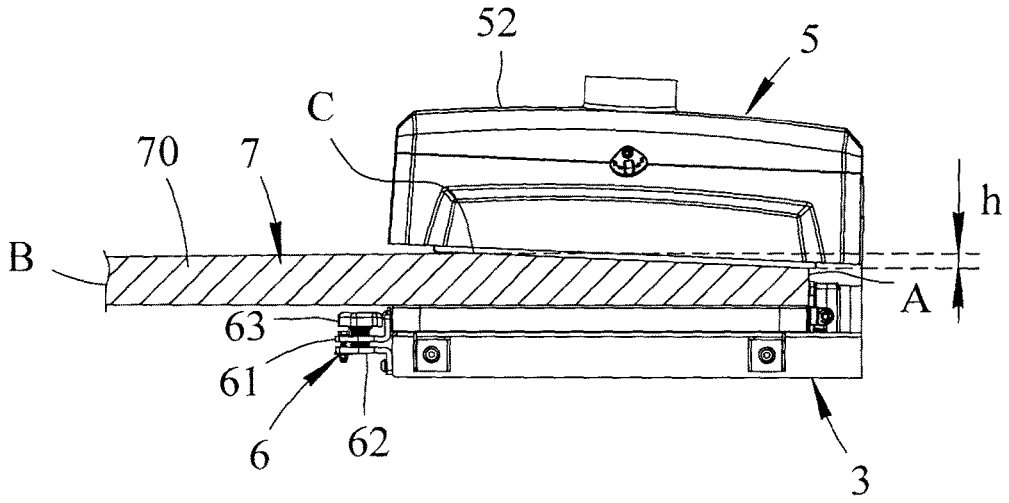
Figure 9:
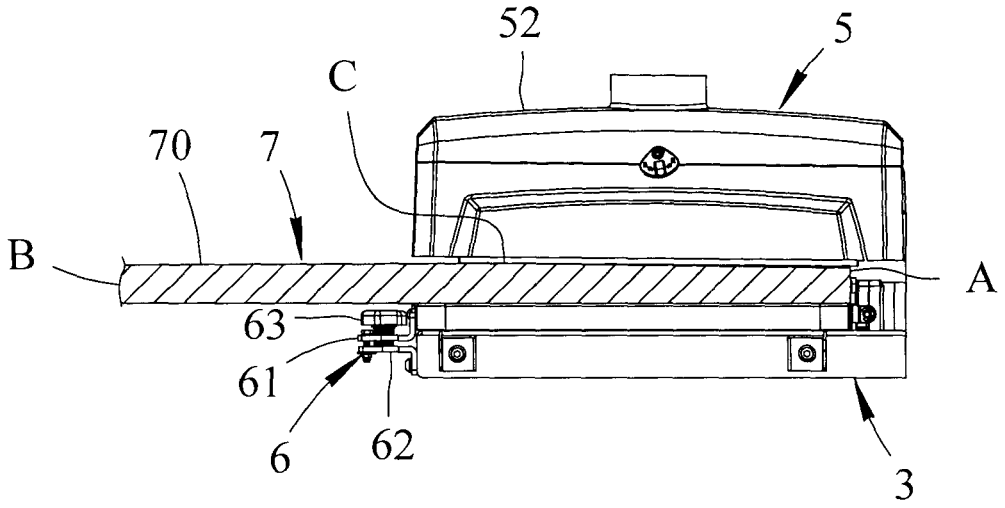

The grinding portion 52 is adjusted to a proper height when grinding a large object 7 as shown in FIG. 6, the length of the grinding portion 52 is long enough to cover the length of the object 7, the whole top surface 70 of the object 7 can be ground. As shown in FIG. 7, if the length of the grinding portion 52 is not long enough to cover top surface 70 of the object 7, the side "B" of the top surface 70 of the object 7 is ground first, and then the other side "A" of the top surface 70 of the object 8 is ground as shown in FIG. 8. Because the grinding portion 52 is not positioned horizontally so that there will be a bump "C" formed on the top surface 70 of the object 7. Assume the height of the bump "C" is "h", the users then operate the knob 63 to adjust the inclination of the grinding portion 52 slightly to grind the bump "C" as shown in FIG. 9 so that the whole top surface 70 is ground to be flat and smooth.

While we have shown and described the embodiment in accordance with the present invention, it should be clear to those skilled in the art that further embodiments may be made without departing from the scope of the present invention.

What is claimed is:

1. A grinding machine comprising:

a support having a connection portion;

a board connected to the connection portion and having a first opening and a second opening;

a transportation device connected across over the first and second openings;

a grinding device having a driving portion and a grinding portion which is connected to the driving portion, the driving portion connected to the support so that the grinding portion is located above the transportation device, and an angle adjustment device connected between the board and the transportation device so as to adjust inclination of the transportation device.

2. The grinding machine as claimed in claim 1, wherein the transportation device has a first side thereof connected to the board, a second side of the transportation device is connected to the angle adjustment device.

3. The grinding machine as claimed in claim 2, wherein the angle adjustment device has a top plate, a bottom plate and a knob, the top plate is connected to the second side of the transportation device, the bottom plate is connected to one side of the board, the top plate is located corresponding to the bottom plate, the knob extends through the top plate and is connected to the bottom plate.

4. The grinding machine as claimed in claim 3, wherein a fastening device is connected between the board and the second side of the transportation device.

5. The grinding machine as claimed in claim 1, wherein the transportation device includes a frame, a rubber belt, a first roller, a second roller and a motor, the first and second rollers are connected to two sides of the frame so as to stretch the rubber belt, the motor is connected to the first roller.

6. The grinding machine as claimed in claim 1, wherein the transportation device has a tightness adjustment device which is connected to the transportation device and the second roller.

7. The grinding machine as claimed in claim 1, wherein the grinding device has a height adjustment device which adjusts a height of the driving portion relative to the transportation device.

* * * * *